US008614654B2

(12) United States Patent
Lee

(10) Patent No.: US 8,614,654 B2
(45) Date of Patent: Dec. 24, 2013

(54) CROSSTALK REDUCTION IN LCD PANELS

(75) Inventor: Yongman Lee, Pleasanton, CA (US)

(73) Assignee: Apple Inc., Cupertino, CA (US)

( * ) Notice: Subject to any disclaimer, the term of this patent is extended or adjusted under 35 U.S.C. 154(b) by 553 days.

(21) Appl. No.: 12/846,597

(22) Filed: Jul. 29, 2010

(65) Prior Publication Data

US 2011/0037747 A1 Feb. 17, 2011

Related U.S. Application Data

(60) Provisional application No. 61/230,103, filed on Jul. 30, 2009.

(51) Int. Cl.
*G09G 3/20* (2006.01)

(52) U.S. Cl.
USPC ..... 345/58; 345/90

(58) Field of Classification Search
USPC ..... 345/211, 58
See application file for complete search history.

(56) References Cited

U.S. PATENT DOCUMENTS 5,220,315 A * 6/1993 Clerc ..... 345/93
5,748,165 A * 5/1998 Kubota et al. ..... 345/96
6,433,764 B1 * 8/2002 Hebiguchi et al. ..... 345/87
6,642,916 B1 * 11/2003 Kodama et al. ..... 345/100
7,623,190 B2 * 11/2009 Kim et al. ..... 349/39
8,253,655 B2 * 8/2012 Yu et al. ..... 345/58
2005/0057480 A1 * 3/2005 Liao et al. ..... 345/98
2005/0117103 A1 * 6/2005 Son ..... 349/141
2008/0001876 A1 * 1/2008 Ito et al. ..... 345/87
2008/0068550 A1 3/2008 Chang et al.
2008/0117155 A1 * 5/2008 Li et al. ..... 345/91
2010/0052772 A1 3/2010 Cho
2010/0073350 A1 3/2010 Lee

* cited by examiner

*Primary Examiner* — Sumati Lefkowitz
*Assistant Examiner* — Jose Soto Lopez
(74) *Attorney, Agent, or Firm* — Fletcher Yoder PC

(57) ABSTRACT

A display configured to reduce intra-pixel crosstalk is provided. In one embodiment, a system includes a processor, a memory, and a display. The display may include a pixel array and associated driving circuitry. The display may be configured to balance charges induced on a gate line and on an adjacent common line of the pixel array in response to application of a first data voltage on a first data line, and to perform such balancing before applying a second data voltage to a second data line adjacent the first data line to reduce or eliminate intra-pixel crosstalk. Additional systems, devices, and methods relating to reducing intra-pixel crosstalk in a display are also disclosed.

23 Claims, 9 Drawing Sheets

CROSSTALK REDUCTION IN LCD PANELS

CROSS-REFERENCE TO RELATED APPLICATIONS

The present application claims the benefit of U.S. Provisional Application No. 61/230,103, filed Jul. 30, 2009, which is incorporated by reference herein.

BACKGROUND

The present disclosure relates generally to liquid crystal display panels and, more particularly, to reducing crosstalk in such panels.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Liquid crystal displays (LCDs) are commonly used as screens or displays for a wide variety of electronic devices, including such consumer electronics as televisions, computers, and handheld devices (e.g., cellular telephones, audio and video players, gaming systems, and so forth). Such LCD devices typically provide a flat display in a relatively thin package that is suitable for use in a variety of electronic goods. In addition, such LCD devices typically use less power than comparable display technologies, making them suitable for use in battery-powered devices or in other contexts where it is desirable to minimize power usage.

LCD devices typically include a plurality of picture elements (pixels) arranged in a matrix. The pixels may be driven by scanning line and data line circuitry to display an image that may be perceived by a user. Individual pixels of an LCD device may variably permit light to pass when an electric field is applied to a liquid crystal material in each pixel. Moreover, certain LCD devices, such as in-plane switching (IPS) and fringe-field switching (FFS) display panels, may supply a common voltage (Vcom) to a common electrode respective to each row of pixels. As the various pixels are activated, signals provided to the various pixel elements may cause crosstalk between the pixels, which may reduce color accuracy and consistency of the pixels.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure generally relates to reducing intra-pixel crosstalk in a display, in which the application of data voltages to one unit pixel (e.g., a blue unit pixel) have an undesirable impact on data voltages previously stored on other unit pixels (e.g., nearby red and green unit pixels). In one embodiment, a display includes a pixel array and is configured to balance the relaxation times of common lines that apply voltages to common electrodes of the array with that of gate lines of the array. By balancing the dissipation of charges induced on these lines by the application of data voltages to pixel electrodes, the net effect of the induced charges on previously-charged pixel electrodes may be reduced.

Various refinements of the features noted above may exist in relation to the presently disclosed embodiments. Additional features may also be incorporated in these various embodiments as well. These refinements and additional features may exist individually or in any combination. For instance, various features discussed below in relation to one or more of the illustrated embodiments may be incorporated into any of the above-described embodiments alone or in any combination. Again, the brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, while the term "exemplary" may be used herein in connection to certain examples of aspects or embodiments of the presently disclosed subject matter, it will be appreciated that these examples are illustrative in nature and that the term "exemplary" is not used herein to denote any preference or requirement with respect to a disclosed aspect or embodiment. Also, the term "substantially equal" is occasionally used herein in connection with comparing parameters relating to the reduction or elimination of intra-pixel crosstalk, and is used to compare values that are sufficiently close to one another that the reduction in intra-pixel crosstalk is of such magnitude that any remaining intra-pixel crosstalk would be imperceptible to a user of the display when compared to a display having no intra-pixel crosstalk.

Figure 1:
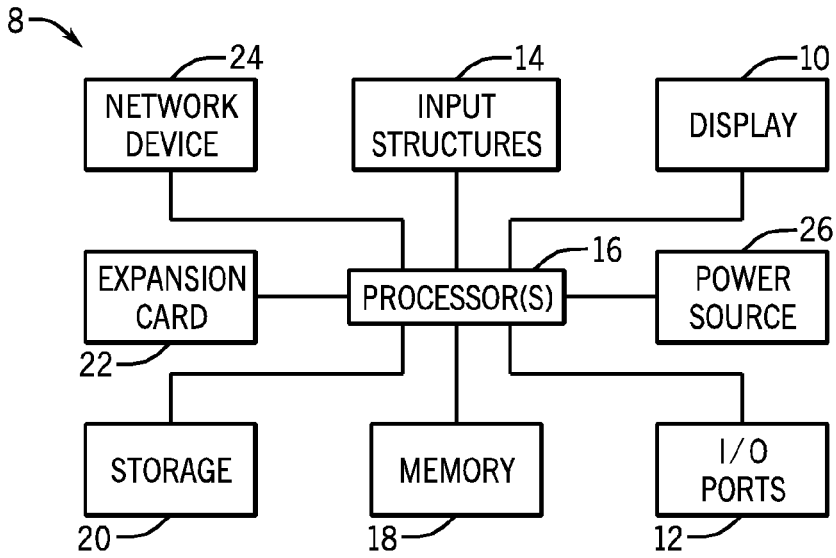
FIG. 1 is a block diagram of exemplary components of an electronic device, in accordance with aspects of the present disclosure.
Figure 3:
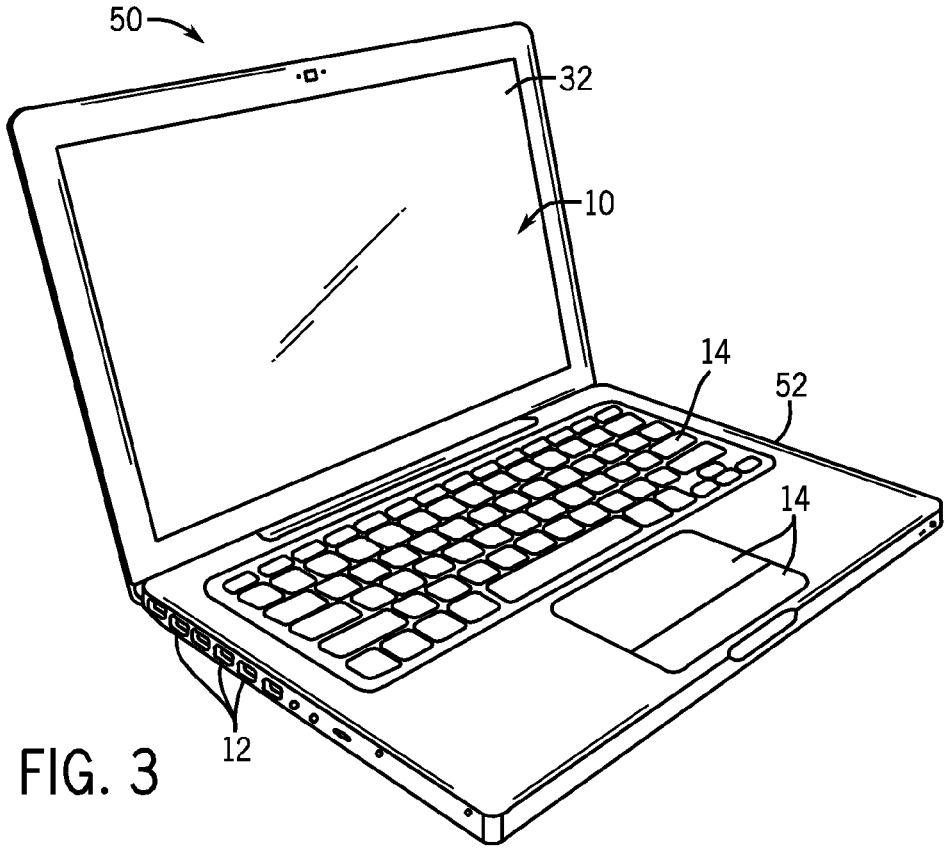
FIG. 3 is a view of a computer in accordance with aspects of the present disclosure.
Figure 2:
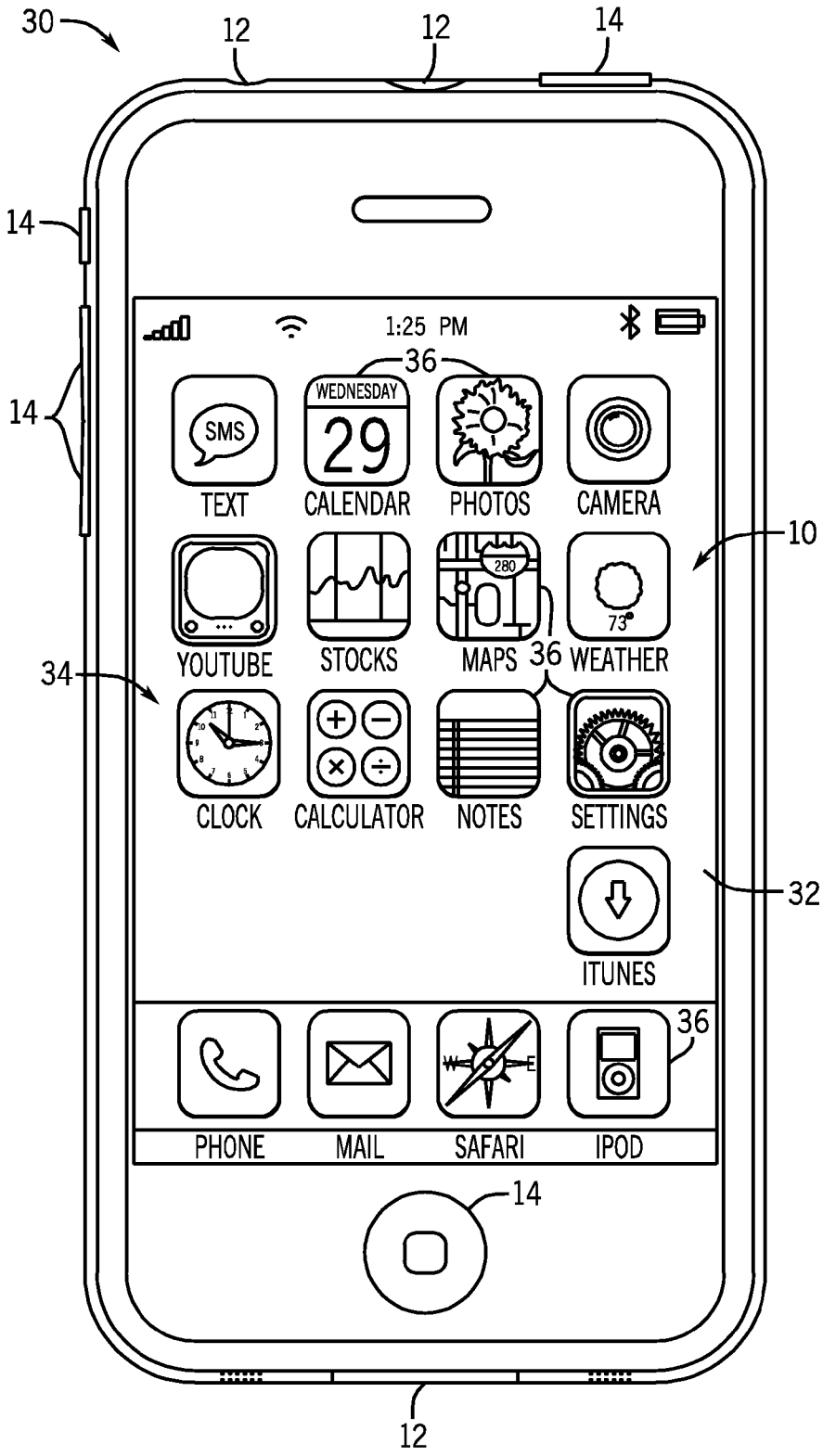
FIG. 2 is a front view of a handheld electronic device in accordance with aspects of the present disclosure.

With the foregoing in mind, a general description of suitable electronic devices using LCD displays exhibiting reduced crosstalk in accordance with the presently disclosed techniques is provided below. In FIG. 1, a block diagram depicting various components that may be present in electronic devices suitable for use with the present techniques is provided. In FIG. 2, one example of a suitable electronic device, here provided as a handheld electronic device, is depicted. In FIG. 3, another example of a suitable electronic device, here provided as a computer system, is depicted. These types of electronic devices, and other electronic devices providing comparable display capabilities, may be used in conjunction with the present techniques.

An example of a suitable electronic device may include various internal and/or external components that contribute to the function of the device. FIG. 1 is a block diagram illustrating the components that may be present in such an electronic device 8 and which may allow the device 8 to function in accordance with the techniques discussed herein. Those of ordinary skill in the art will appreciate that the various functional blocks shown in FIG. 1 may include hardware elements (including circuitry), software elements (including computer code stored on a computer-readable medium) or a combination of both hardware and software elements. It should further be noted that FIG. 1 is merely one example of a particular implementation and is merely intended to illustrate the types of components that may be present in a device 8. For example, in the presently illustrated embodiment, these components may include a display 10, I/O ports 12, input structures 14, one or more processors 16, a memory device 18, a non-volatile storage 20, expansion card(s) 22, a networking device 24, and a power source 26.

With regard to each of these components, the display 10 may be used to display various images generated by the device 8. In one embodiment, the display 10 may be a liquid crystal display (LCD). For example, the display 10 may be an LCD employing fringe field switching (FFS), in-plane switching (IPS), or other techniques useful in operating such LCD devices. Additionally, in certain embodiments of the electronic device 8, the display 10 may be provided in conjunction with a touch-sensitive element, such as a touch-screen, that may be used as part of the control interface for the device 8.

The I/O ports 12 may include ports configured to connect to a variety of external devices, such as a power source, headset or headphones, or other electronic devices (such as handheld devices and/or computers, printers, projectors, external displays, modems, docking stations, and so forth). The I/O ports 12 may support any interface type, such as a universal serial bus (USB) port, a video port, a serial connection port, an IEEE-1394 port, an Ethernet or modem port, and/or an AC/DC power connection port.

The input structures 14 may include the various devices, circuitry, and pathways by which user input or feedback is provided to the processor 16. Such input structures 14 may be configured to control a function of the device 8, applications running on the device 8, and/or any interfaces or devices connected to or used by the electronic device 8. For example, the input structures 14 may allow a user to navigate a displayed user interface or application interface. Examples of the input structures 14 may include buttons, sliders, switches, control pads, keys, knobs, scroll wheels, keyboards, mice, touchpads, and so forth.

In certain embodiments, an input structure 14 and display 10 may be provided together, such an in the case of a touch-screen where a touch sensitive mechanism is provided in conjunction with the display 10. In such embodiments, the user may select or interact with displayed interface elements via the touch sensitive mechanism. In this way, the displayed interface may provide interactive functionality, allowing a user to navigate the displayed interface by touching the display 10.

User interaction with the input structures 14, such as to interact with a user or application interface displayed on the display 10, may generate electrical signals indicative of the user input. These input signals may be routed via suitable pathways, such as an input hub or bus, to the processor(s) 16 for further processing.

The processor(s) 16 may provide the processing capability to execute the operating system, programs, user and application interfaces, and any other functions of the electronic device 8. The processor(s) 16 may include one or more microprocessors, such as one or more "general-purpose" microprocessors, one or more special-purpose microprocessors and/or ASICS, or some combination of such processing components. For example, the processor 16 may include one or more reduced instruction set (RISC) processors, as well as graphics processors, video processors, audio processors and/or related chip sets.

The instructions or data to be processed by the processor(s) 16 may be stored in a computer-readable medium, such as a memory 18. Such a memory 18 may be provided as a volatile memory, such as random access memory (RAM), and/or as a non-volatile memory, such as read-only memory (ROM). The memory 18 may store a variety of information and may be used for various purposes. For example, the memory 18 may store firmware for the electronic device 8 (such as a basic input/output instruction or operating system instructions), various programs, applications, or routines executed on the electronic device 8, user interface functions, processor functions, and so forth. In addition, the memory 18 may be used for buffering or caching during operation of the electronic device 8.

The components may further include other forms of computer-readable media, such as a non-volatile storage 20, for persistent storage of data and/or instructions. The non-volatile storage 20 may include flash memory, a hard drive, or any other optical, magnetic, and/or solid-state storage media. The non-volatile storage 20 may be used to store firmware, data files, software, wireless connection information, and any other suitable data.

The embodiment illustrated in FIG. 1 may also include one or more card or expansion slots. The card slots may be configured to receive an expansion card 22 that may be used to add functionality, such as additional memory, I/O functionality, or networking capability, to the electronic device 8. Such an expansion card 22 may connect to the device through any type of suitable connector, and may be accessed internally or external to the housing of the electronic device 8. For example, in one embodiment, the expansion card 22 may be a flash memory card, such as a SecureDigital (SD) card, mini- or microSD, CompactFlash card, Multimedia card (MMC), or the like.

The components depicted in FIG. 1 also include a network device 24, such as a network controller or a network interface card (NIC). In one embodiment, the network device 24 may be a wireless NIC providing wireless connectivity over any 802.11 standard or any other suitable wireless networking standard. The network device 24 may allow the electronic device 8 to communicate over a network, such as a Local Area Network (LAN), Wide Area Network (WAN), or the Internet. Further, the electronic device 8 may connect to and send or receive data with any device on the network, such as portable electronic devices, personal computers, printers, and so forth. Alternatively, in some embodiments, the electronic device 8 may not include a network device 24. In such an embodiment, a NIC may be added as an expansion card 22 to provide similar networking capability as described above.

Further, the components may also include a power source 26. In one embodiment, the power source 26 may be one or more batteries, such as a lithium-ion polymer battery or other type of suitable battery. The battery may be user-removable or may be secured within the housing of the electronic device 8, and may be rechargeable. Additionally, the power source 26 may include AC power, such as provided by an electrical outlet, and the electronic device 8 may be connected to the power source 26 via a power adapter. This power adapter may also be used to recharge one or more batteries if present.

With the foregoing in mind, FIG. 2 illustrates an electronic device 8 in the form of a handheld device 30, here a cellular or other mobile telephone. It should be noted that while the depicted handheld device 30 is provided in the context of a cellular telephone, other types of handheld devices (such as media players for playing music and/or video, personal data organizers, handheld game platforms, and/or combinations of such devices) may also be suitably provided as the electronic device 8. Further, a suitable handheld device 30 may incorporate the functionality of one or more types of devices, such as a media player, a cellular phone, a gaming platform, a personal data organizer, and so forth.

For example, in the depicted embodiment, the handheld device 30 is in the form of a cellular telephone that may provide various additional functionalities (such as the ability to take pictures, record audio and/or video, listen to music, play games, and so forth). As discussed with respect to the general electronic device of FIG. 1, the handheld device 30 may allow a user to connect to and communicate through the Internet or through other networks, such as local or wide area networks. The handheld electronic device 30, may also communicate with other devices using short-range connections, such as Bluetooth and near field communication. By way of example, the handheld device 30 may be a model of an iPod® or iPhone® available from Apple Inc. of Cupertino, Calif.

In the depicted embodiment, the handheld device 30 includes an enclosure or body that protects the interior components from physical damage and shields them from electromagnetic interference. The enclosure may be formed from any suitable material such as plastic, metal or a composite material and may allow certain frequencies of electromagnetic radiation to pass through to wireless communication circuitry within the handheld device 30 to facilitate wireless communication.

In the depicted embodiment, the enclosure includes user input structures 14 through which a user may interface with the device. Each user input structure 14 may be configured to help control a device function when actuated. For example, in a cellular telephone implementation, one or more of the input structures 14 may be configured to invoke a "home" screen or menu to be displayed, to toggle between a sleep and a wake mode, to silence a ringer for a cell phone application, to increase or decrease a volume output, and so forth.

In the depicted embodiment, the handheld device 30 includes a display 10 in the form of an LCD 32. The LCD 32 may be used to display a graphical user interface (GUI) 34 that allows a user to interact with the handheld device 30. The GUI 34 may include various layers, windows, screens, templates, or other graphical elements that may be displayed in all, or a portion, of the LCD 32. Generally, the GUI 34 may include graphical elements that represent applications and functions of the electronic device. The graphical elements may include icons 36 and other images representing buttons, sliders, menu bars, and the like. The icons 36 may correspond to various applications of the electronic device that may open upon selection of a respective icon 36. Furthermore, selection of an icon 36 may lead to a hierarchical navigation process, such that selection of an icon 36 leads to a screen that includes one or more additional icons or other GUI elements. The icons 36 may be selected via a touchscreen included in the display 10, or may be selected by a user input structure 14, such as a wheel or button.

The handheld electronic device 30 also may include various input and output (I/O) ports 12 that allow connection of the handheld device 30 to external devices. For example, one I/O port 12 may be a port that allows the transmission and reception of data or commands between the handheld electronic device 30 and another electronic device, such as a computer. Such an I/O port 12 may be a proprietary port from Apple Inc. or may be an open standard I/O port.

In addition to handheld devices 30, such as the depicted cellular telephone of FIG. 2, an electronic device 8 may also take the form of a computer or other type of electronic device. Such computers may include computers that are generally portable (such as laptop, notebook, and tablet computers) as well as computers that are generally used in one place (such as conventional desktop computers, workstations and/or servers). In certain embodiments, the electronic device 8 in the form of a computer may be a model of a MacBook®, MacBook® Pro, MacBook Air®, iMac®, Mac® mini, or Mac Pro® available from Apple Inc. By way of example, an electronic device 8 in the form of a laptop computer 50 is illustrated in FIG. 3 in accordance with one embodiment of the present invention. The depicted computer 50 includes a housing 52, a display 10 (such as the depicted LCD 32), input structures 14, and input/output ports 12.

In one embodiment, the input structures 14 (such as a keyboard and/or touchpad) may be used to interact with the computer 50, such as to start, control, or operate a GUI or applications running on the computer 50. For example, a keyboard and/or touchpad may allow a user to navigate a user interface or application interface displayed on the LCD 32.

As depicted, the electronic device 8 in the form of computer 50 may also include various input and output ports 12 to allow connection of additional devices. For example, the computer 50 may include an I/O port 12, such as a USB port or other port, suitable for connecting to another electronic device, a projector, a supplemental display, and so forth. In addition, the computer 50 may include network connectivity, memory, and storage capabilities, as described with respect to FIG. 1. As a result, the computer 50 may store and execute a GUI and other applications.

With the foregoing discussion in mind, it may be appreciated that an electronic device 8 in the form of either a handheld device 30 or a computer 50 may be provided with an LCD 32 as the display 10. Such an LCD 32 may be utilized to display the respective operating system and application interfaces running on the electronic device 8 and/or to display data, images, or other visual outputs associated with an operation of the electronic device 8.

In embodiments in which the electronic device 8 includes an LCD 32, the LCD 32 may include a display panel having an array or matrix of picture elements (i.e., pixels). In operation, the LCD 32 generally operates to modulate the transmission of light through the pixels by controlling the orientation of liquid crystal disposed at each pixel. In general, the orientation of the liquid crystals is controlled by a varying an electric field associated with each respective pixel, with the liquid crystals being oriented at any given instant by the properties (strength, shape, and so forth) of the electric field.

Different types of LCDs may employ different techniques in manipulating these electrical fields and/or the liquid crystals. For example, certain LCDs employ transverse electric field modes in which the liquid crystals are oriented by applying an in-plane electrical field to a layer of the liquid crystals. Example of such techniques include in-plane switching (IPS) and fringe field switching (FFS) techniques, which differ in the electrode arrangement employed to generate the respective electrical fields.

While control of the orientation of the liquid crystals in such displays may be sufficient to modulate the amount of light emitted by a pixel, color filters may also be associated with the pixels to allow specific colors of light to be emitted by each pixel. For example, in embodiments where the LCD 32 is a color display, each pixel of a group of pixels may correspond to a different primary color. For example, in one embodiment, a group of pixels may include a red pixel, a green pixel, and a blue pixel, each associated with an appropriately colored filter. The intensity of light allowed to pass through each pixel (by modulation of the corresponding liquid crystals), and its combination with the light emitted from other adjacent pixels, determines what color(s) are perceived by a user viewing the display. As the viewable colors are formed from individual color components (e.g., red, green, and blue) provided by the colored pixels, the colored pixels may also be referred to as unit pixels.

Figure 4:
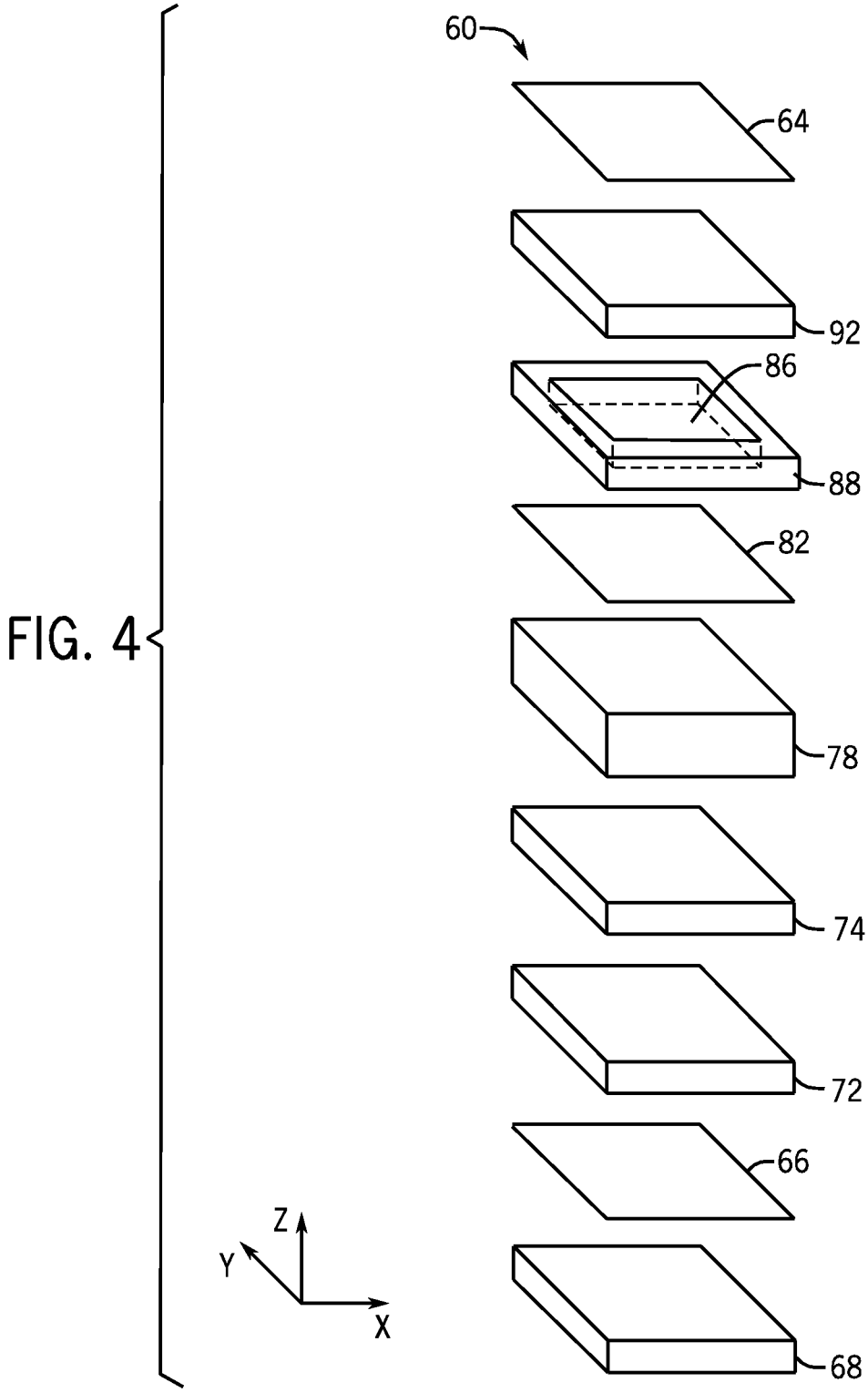
FIG. 4 is an exploded view of exemplary layers of a pixel of an LCD panel, in accordance with aspects of the present disclosure.

With the foregoing in mind, and turning once again to the figures, FIG. 4 depicts an exploded view of different layers of a pixel of an LCD 32. The pixel 60 includes an upper polarizing layer 64 and a lower polarizing layer 66 that polarize light emitted by a backlight assembly 68 or light-reflective surface. A lower substrate 72 is disposed above the polarizing layer 66 and is generally formed from a light-transparent material, such as glass, quartz, and/or plastic.

A thin film transistor (TFT) layer 74 is depicted as being disposed above the lower substrate 72. For simplicity, the TFT layer 74 is depicted as a generalized structure in FIG. 4. In practice, the TFT layer may itself include various conductive, non-conductive, and semiconductive layers and structures which generally form the electrical devices and pathways which drive operation of the pixel 60. For example, in an embodiment in which the pixel 60 is part of an FFS LCD panel, the TFT layer 74 may include the respective data lines, scanning or gate lines, pixel electrodes, and common electrodes (as well as other conductive traces and structures) of the pixel 60. Such conductive structures may, in light-transmissive portions of the pixel, be formed using transparent conductive materials, such as indium tin oxide (ITO). In addition, the TFT layer 74 may include insulating layers (such as a gate insulating film) formed from suitable transparent materials (such as silicon oxide) and semiconductive layers formed from suitable semiconductor materials (such as amorphous silicon). In general, the respective conductive structures and traces, insulating structures, and semiconductor structures may be suitably disposed to form the respective pixel and common electrodes, a TFT, and the respective data and scanning lines used to operate the pixel 60, as described in further detail below with regard to FIG. 5. The TFT layer 74 may also include an alignment layer (formed from polyimide or other suitable materials) at the interface with the liquid crystal layer 78.

The liquid crystal layer 78 includes liquid crystal particles or molecules suspended in a fluid or gel matrix. The liquid crystal particles may be oriented or aligned with respect to an electrical field generated by the TFT layer 74. The orientation of the liquid crystal particles in the liquid crystal layer 78 determines the amount of light transmission through the pixel 60. Thus, by modulation of the electrical field applied to the liquid crystal layer 78, the amount of light transmitted though the pixel 60 may be correspondingly modulated.

Disposed on the other side of the liquid crystal layer 78 from the TFT layer 74 may be one or more alignment and/or overcoating layers 82 interfacing between the liquid crystal layer 78 and an overlying color filter 86. The color filter 86, in certain embodiments, may be a red, green, or blue filter, such that each pixel 60 corresponds to a primary color when light is transmitted from the backlight assembly 68 through the liquid crystal layer 78 and the color filter 86.

The color filter 86 may be surrounded by a light-opaque mask or matrix, e.g., a black mask 88 which circumscribes the light-transmissive portion of the pixel 60. For example, in certain embodiments, the black mask 88 may be sized and shaped to define a light-transmissive aperture over the liquid crystal layer 78 and around the color filter 86 and to cover or mask portions of the pixel 60 that do not transmit light, such as the scanning line and data line driving circuitry, the TFT, and the periphery of the pixel 60. In the depicted embodiment, an upper substrate 92 may be disposed between the black mask 88 and color filter 86 and the polarizing layer 64. In such an embodiment, the upper substrate may be formed from light-transmissive glass, quartz, and/or plastic.

Figure 5:
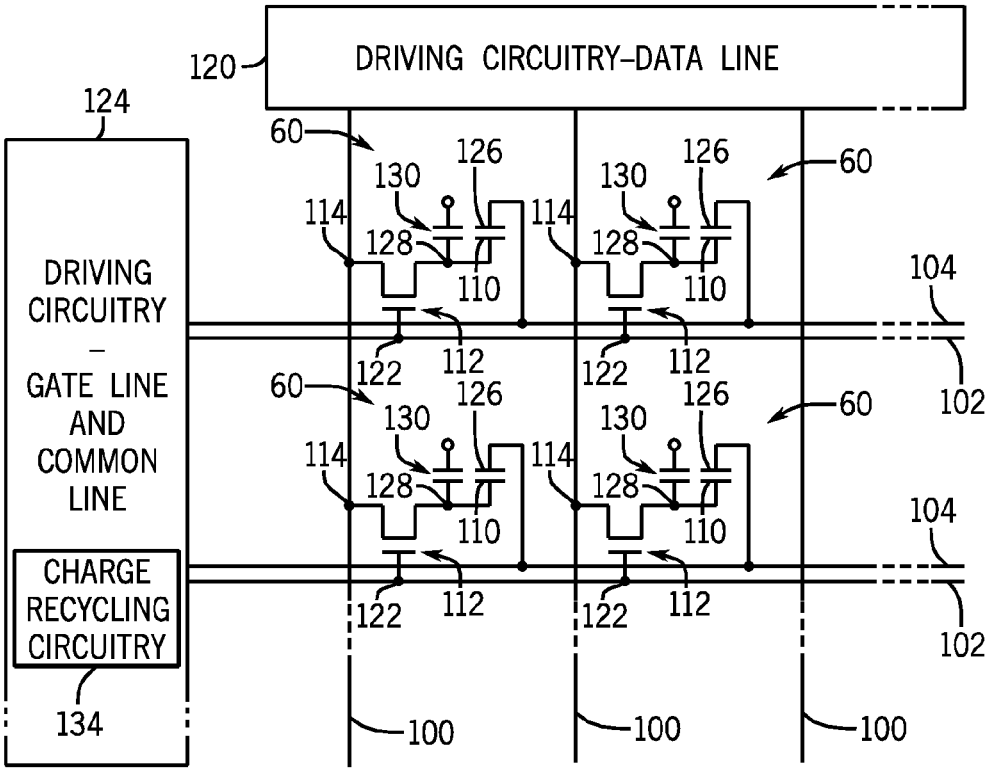
FIG. 5 is a circuit diagram of switching and display circuitry of LCD pixels, in accordance with aspects of the present disclosure.

Referring now to FIG. 5, an example of a circuit view of pixel driving circuitry found in an LCD 32 is provided. In one embodiment, the LCD 32 may include a low-temperature polycrystalline silicon LCD and both the driving circuitry and the pixel circuitry depicted in FIG. 5 may be embodied in the TFT layer 74 (i.e., formed on the same substrate) as described with respect to FIG. 4. As depicted, the pixels 60 may be disposed in a matrix that forms an image display region of an LCD 32. In such a matrix, each pixel 60 may be generally defined by the intersection of data or source lines (or "wires") 100 and scanning or gate lines (or "wires") 102. The pixel array may also include common lines (or "wires") 104 to apply voltages to common electrodes of the pixel array.

Each pixel 60 includes a pixel electrode 110 and thin film transistor (TFT) 112 for switching the pixel electrode 110. In the depicted embodiment, the source 114 of each TFT 112 is electrically connected to a data line 100, extending from respective data line driving circuitry 120. Similarly, in the depicted embodiment, the gate 122 of each TFT 112 is electrically connected to a scanning or gate line 102, extending from driving circuitry 124. In addition to circuitry for driving the gate lines 102, the driving circuitry 124 also includes common line driving circuitry to apply voltages to the common lines 104, which allow such voltages to be applied to common electrodes 126. In the depicted embodiment, the pixel electrode 110 is electrically connected to a drain 128 of the respective TFT 112.

In one embodiment, the data line driving circuitry 120 sends image or data signals to the pixels via the respective data lines 100. Such image signals may be applied by line-sequence, i.e., the data lines 100 may be sequentially activated during operation. The scanning lines 102 may apply scanning signals from the driving circuitry 124 to the gate 122 of each TFT 112 to which the respective scanning lines 102 connect. Such scanning signals may be applied by line-sequence with a predetermined timing and/or in a pulsed manner.

Each TFT 112 serves as a switching element which may be activated and deactivated (i.e., turned on and off) for a predetermined period based on the respective presence or absence of a scanning signal at the gate 122 of the TFT 112. When activated, a TFT 112 may store the image signals received via a respective data line 100 as a charge in the pixel electrode 110 with a predetermined timing.

The image signals stored at the pixel electrode 110 may be used to generate an electrical field between the respective pixel electrode 110 and the common electrode 126. Such an electrical field may align liquid crystals within the liquid crystal layer 78 (FIG. 4) to modulate light transmission through the liquid crystal layer 78. In some embodiments, a storage capacitor 130 may also be provided in parallel to the liquid crystal capacitor formed between the pixel electrode 110 and the common electrode 126 to prevent leakage of the stored image signal at the pixel electrode 110. For example, such a storage capacitor may be provided between the drain 128 of the respective TFT 112 and a separate capacitor line. Additionally, either or both of the driving circuitries 120 and 124 may include charge recycling circuitry 134 to facilitate charge conservation and to reduce power consumption of the display panel.

Figure 6:
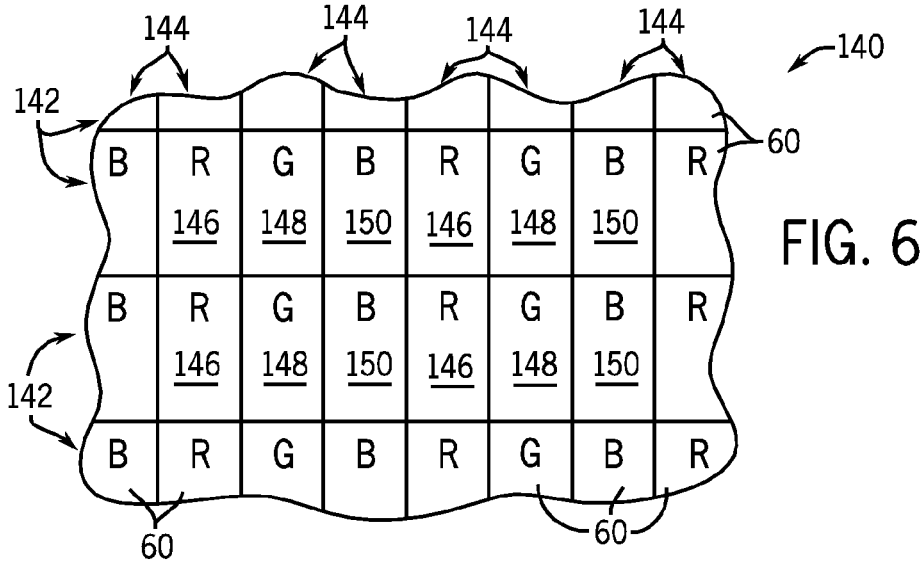
FIG. 6 is a general representation of a portion of an LCD pixel array in accordance with aspects of the present disclosure.

As depicted in FIG. 6, an LCD pixel array 140 may include a plurality of pixels 60 arranged in rows 142 and columns 144. In the presently illustrated embodiment, the array 140 includes alternating columns of red pixels 146, green pixels 148, and blue pixels 150. It is noted, however, that these various colored pixels may be provided in other arrangements, such as those in which the order of columns associated with respective colors is different, or in which the columns include pixels 60 of different colors. Additionally, the pixels 60 may include other colors in addition to, or in place of, those noted above.

Each line or wire of the pixel array has a finite resistance, and operation of the display panel results in parasitic capacitances among the various lines. For instance, a gate line 102 has a resistance ("$R_{gate}$") and parasitic capacitances with a data line 100 ("$C_{dg}$") and a common line 104 ("$C_{cg}$"). Similarly, the data line 100 has a resistance ("$R_{data}$") and parasitic capacitances with a gate line 102 ("$C_{dg}$") and a common line 104 ("$C_{dc}$"), and the common line 104 has a resistance ("$R_{com}$") and parasitic capacitances with a gate line 102 ("$C_{cg}$") and a data line 100 ("$C_{dc}$").

In a low resolution display, the capacitance between data line and gate line may be ignored (i.e., assume $C_{dg}$=0). In high resolution displays, however, as the $C_{dg}$ increases, it couples gate line voltage to both data line 100 and common line 104. Further, in such high resolution displays, the increasing $C_{dg}$ may cause voltage on the gate line 102 ("$V_{gate}$") to directly impact voltages on data line 100 or stored in pixel electrodes 110 ("$V_{data}$"), and to indirectly affect voltages on common line 104 ("$V_{com}$") indirectly (e.g., via the series connection of $C_{dg}$ and $C_{dc}$). Thus, error on $V_{data}$ occurs through a $C_{dg}$-$C_{dc}$ capacitive voltage divider when $V_{com}$ and $V_{gate}$ fluctuate. Accordingly, as signals are applied to various lines (e.g., data lines 100, scanning lines 102, and common lines 104) of the pixels 60, crosstalk between the various lines may impact the display characteristics of the pixels 60. For instance, such crosstalk may reduce the color accuracy and consistency of an LCD 32 including such pixels 60.

Figure 7:
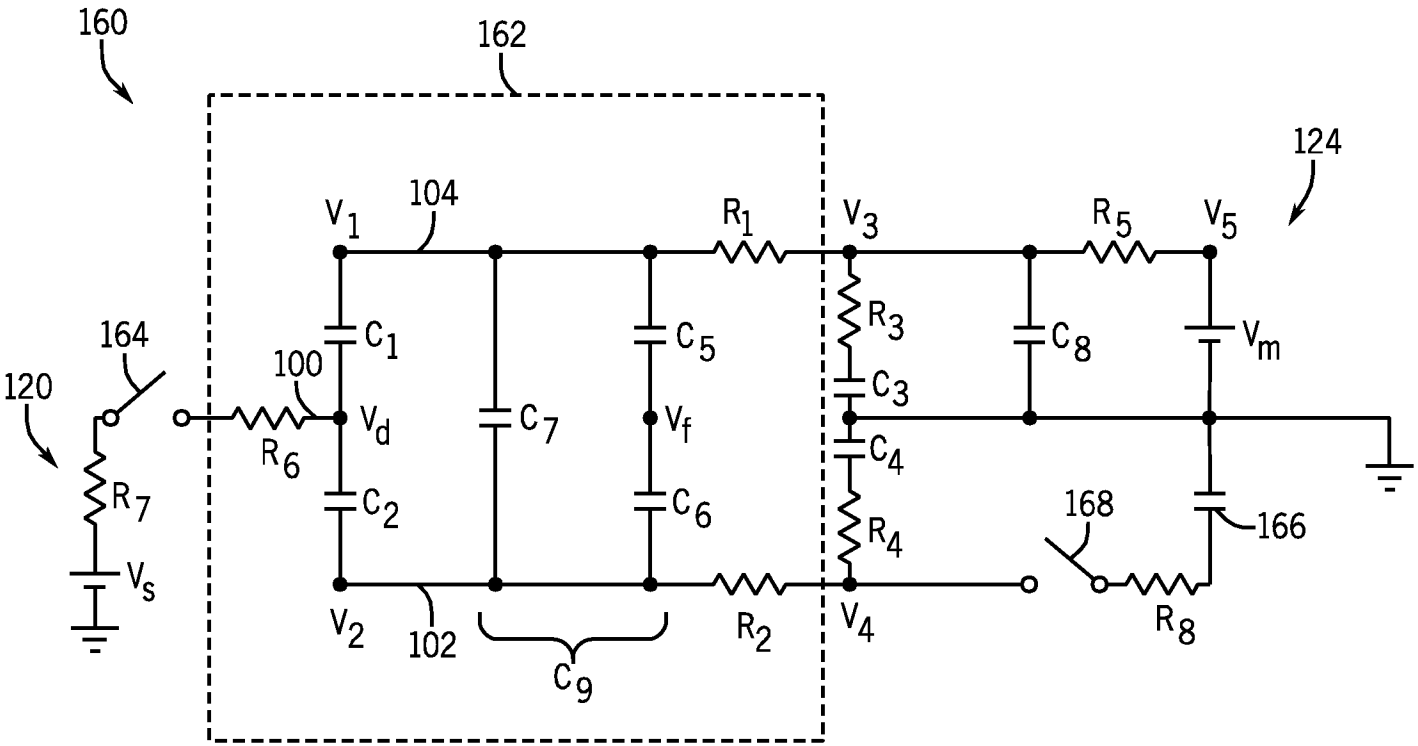
FIG. 7 is a simplified model of an LCD panel and associated driving circuitry in accordance with aspects of the present disclosure.

A simplified model 160 of a display panel and associated driving circuitry depicting various circuit components and parasitic capacitances is provided in FIG. 7 for explanatory purposes and in accordance with one embodiment. The model 160 includes certain components and capacitances in the pixel array (as generally indicated by reference numeral 162), as well as other circuit components and capacitances of other portions of the LCD 32, such as the driving circuitries 120 and 124.

In operation, data signals are applied to a data line 100 via the driving circuitry 120 (modeled as a voltage source ("$V_S$") and a resistance ("$R_7$") in FIG. 7). In the present embodiment, a demultiplexing switch 164 is provided for separating RGB data values and applying these values to respective individual data lines 100 (modeled as having a resistance "$R_6$"). In the present model 160, the data line driving circuitry may write a voltage ("$V_d$") to a pixel electrode 110 (e.g., of a green pixel) and may have previously written a voltage ("$V_f$") to an adjacent pixel electrode 110 (e.g., of a red pixel).

As previously noted, the data voltages on the pixel electrodes 110 or data lines 100 may be coupled to a gate line 102 and a common line 104 through parasitic capacitance. These parasitic capacitances include a capacitance between the currently driven data line 100 and the common line 104 ("$C_1$" or $C_{dc}$ for the currently driven data line 100), a capacitance between the currently driven data line 100 and the gate line 102 ("$C_2$" or $C_{dg}$ for the currently driven data line 100), a capacitance between the previously written data line 100 or pixel electrode 110 and the common line 104 ("$C_5$" or $C_{dc}$ for the previously written data line 100), and a capacitance between the previously written data line 100 or pixel electrode 110 and the gate line 102 ("$C_6$" or $C_{dg}$ for the previously written data line 100). The voltages on the common line 104 and the data line 102 are represented as voltages $V_1$ and $V_2$, respectively. The resistances of the common line 104 and the data line 102 are similarly represented as resistances $R_1$ and $R_2$, respectively. Additionally, with respect to modeled capacitances in the pixel array, $C_7$ represents the sum of $C_{cg}$ in both the currently-written and previously-written data lines, while $C_9$ represents the sum of $C_7$ and the series connection of $C_5$ and $C_6$.

A common voltage applied to the common line 104 by the driving circuitry 124 is represented in model 160 as $V_3$, and a gate voltage applied to the gate line 102 by the circuitry 124 is represented as $V_4$. The voltage $V_3$ is provided by a voltage source $V_m$ outputting a voltage $V_5$ (and modeled as a non-ideal DC supply as represented by resistance $R_5$ and capacitance $C_8$). The voltage $V_4$ is provided via a charge pump 166, resistance $R_8$, and switch 168 (which may open during data writing). The modeled display may also include a resistance $R_3$ and stabilizing capacitor $C_3$ joined between the common line 104 and ground, and a resistance $R_4$ and stabilizing capacitor $C_4$ joined between the gate line 102 and ground, as generally depicted in FIG. 7.

In operation, the data line 100 is driven by a step voltage, which causes charge injection to the other lines through the parasitic capacitances. Such injected charges generally dissipate over time through the line resistances to ground. But if gates are turned off when the injected charge has not fully dissipated, it remains as error voltage on data lines. In case of writing in RGB order, "Red" data may be affected most while "Blue" data may be affected least. Through the parasitic capacitances, writing of data to a pixel electrode (e.g., via voltage $V_d$) may negatively impact the previously written data (e.g., represented by voltage $V_f$) to a pixel electrode of an adjacent pixel. In some embodiments, this may result in color-dependent crosstalk, also referred to herein as intra-pixel crosstalk. In some instances, this intra-pixel crosstalk may have a significant impact on the data values stored in pixel electrodes. For example, in one instance in which 1.0 volts is first written to a red pixel, 2.0 volts is then written to a green pixel, and 3.0 volts is then written to a blue pixel, intra-pixel crosstalk from these successive writes may result in only 0.8 volts remaining on the red pixel following writing of the green and blue pixels (a twenty percent reduction) and only 1.8 volts remaining on the green pixel following writing of the blue pixel (a ten percent reduction). Combined with a full 3.0 volts on the blue pixel, the net effect of this intra-pixel crosstalk may be a noticeable and undesirable color shift toward the blue end of the color spectrum.

Figure 8:
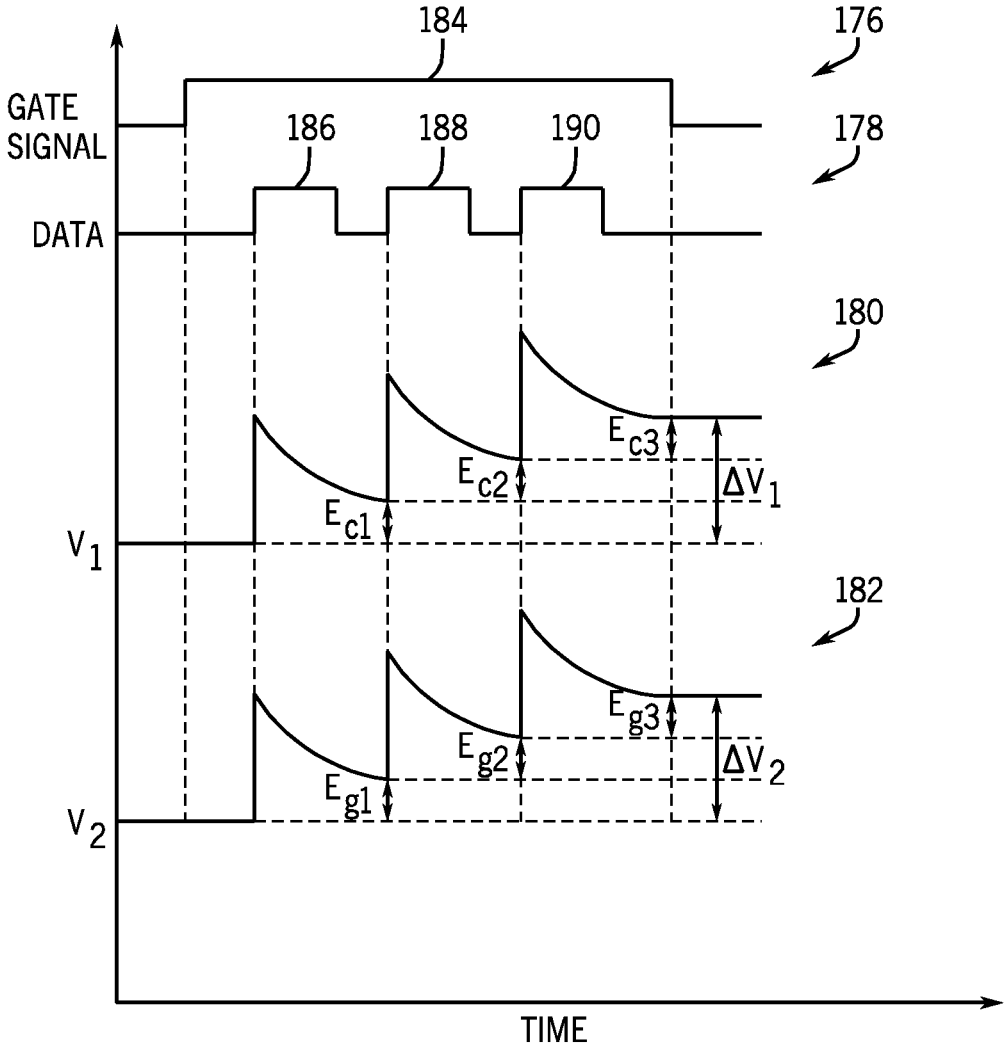
FIG. 8 generally depicts application of data voltages to a data line of the LCD panel and error voltages that may be induced in gate and common lines in accordance with aspects of the present disclosure.

By way of example, FIG. 8 generally depicts induced voltage error caused by application of data signals to data lines 100 in accordance with one embodiment. Particularly, FIG. 8 includes a gate signal waveform 176, a data signal waveform 178, and waveforms 180 and 182 representative of voltages induced on the common line 104 and gate line 102 of FIG. 7 (which in turn impact previously written data values on the pixel electrodes). In the present depiction, a gate signal 184 activates the transistors of a row of pixels, and three data values 186, 188, and 190 are output by the source driver circuitry 120 for application to consecutive data lines 100. For example, the data values 186, 188, and 190 may represent red, green, and blue data to be applied to respective data lines 100 tied to red, green, and blue pixels (e.g., via demultiplexing switch 164). While the data values 186, 188, and 190 are depicted as pulses of similar size for ease of explanation, it is noted that these values may differ from one another in practice.

The application of the data value 186 to a first data line 100 results in changes in $V_1$ and $V_2$ on the common line 104 and the gate line 102. While a portion of the injected charge on the common line 104 and gate line 102 may dissipate over time, some of the injected charge (e.g., $E_{c1}$ and $E_{g1}$) may remain on these lines upon the application of the data value 188 to the next data line 100. The application of the data values 188 and 190 to adjacent data lines 100 may also result in additional error voltages being added to voltages $V_1$ and $V_2$ (as generally represented by $E_{c2}$, $E_{g2}$, $E_{c3}$, and $E_{g3}$). The sum of the impacts of $E_{c1}$, $E_{c2}$, and $E_{c3}$ on voltage $V_1$ is represented as $\Delta V_1$, while the sum of the impacts of $E_{g1}$, $E_{g2}$, and $E_{g3}$ on voltage $V_2$ is represented as $\Delta V_2$. The impact of these changes on a voltage previously-written to another pixel electrode may be calculated as:

$$\Delta V_f=[(\Delta V_1-\Delta V_2)/(1+\alpha)], \text{ where } \alpha=C_{dc}/C_{dg}=C_1/C_2$$

Figure 9:
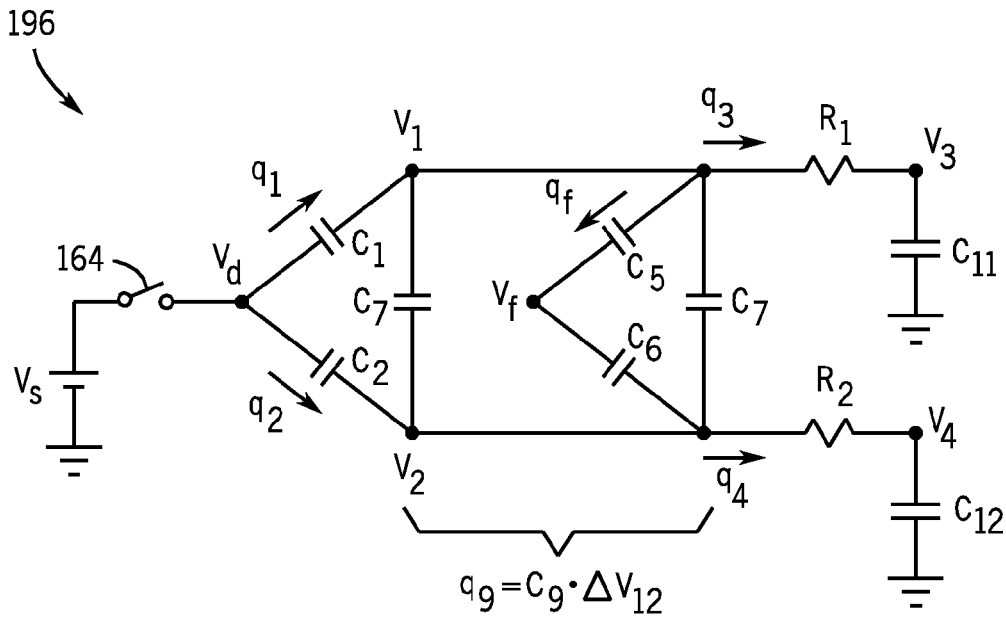
FIGS. 9 and 10 are simplified charge transfer models representing movement of charge through the LCD panel modeled in FIG. 7 in accordance with aspects of the present disclosure.

A charge transfer model 196 of this effect on a previously-written (i.e., "floated") data line is provided in FIG. 9 in accordance with one embodiment. As depicted in this model, charge $q_1$ passes to the common line (and increases voltage $V_1$) via the capacitance $C_1$, and charge $q_2$ passes to the gate line (and increases voltage $V_2$) via the capacitance $C_2$. Charges $q_3$ and $q_4$ pass through the resistances of the common line and the gate line, respectively. In the depicted model 196, capacitance $C_{11}$ represents the effective capacitance of the portion of the driving circuitry modeled in FIG. 7 as capacitances $C_3$ and $C_8$ and resistances $R_3$ and $R_5$, while capacitance $C_{12}$ represents the effective capacitance of the portion of the driving circuitry modeled as capacitance $C_4$ and resistance $R_4$ in FIG. 7. Charge $q_9$ may represent net charge transfer between the gate and common lines resulting from the combined parasitic capacitances ($C_9$) and the various charge paths between these two lines and from the voltage difference ($\Delta V_{12}$) between the two lines. More specifically, capacitance $C_9$ in the model 196 equals the capacitances between the common and gate line for the entire display panel plus the series (also referred to herein as "$C_f$") of capacitances between the floating data line and the common line and between the floating data line and the gate line. The charge transfer through the series capacitance $C_f$ may be expressed as:

$$q_f=C_f\times\Delta V_{12}=(C_f/C_9)\times q_9.$$

Additionally, the change in voltage on the previously-written pixel electrode (i.e., $\Delta V_f$) may also be expressed as:

$$\Delta V_f=-q_f/C_{def}=-(C_f/C_{def})\times\Delta V_{12}.$$

In an ideal condition, parasitic wire resistances $R_1$ and $R_2$ would equal zero, and $V_1$ and $V_2$ would be held steady by ideal DC voltage sources. In practice, however, beneficial results may be obtained by keeping net charge transfer to the previously written data line at zero by controlling relaxation time of the common and gate wires such that the voltage difference between the common line ($V_1$) and the gate line ($V_2$) is zero.

Figure 10:
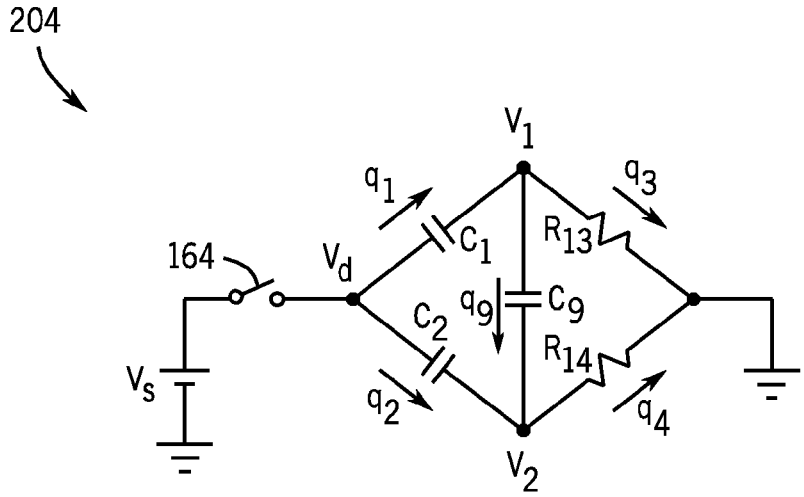

For example, a model 204 is provided in accordance with one embodiment in FIG. 10, and is a simplified representation of charge transfer through the pixel array and driving circuitry. In this model, resistance $R_{13}$ generally represents the combined series resistance of the resistance $R_1$ (the resistance of the pixel array common line) and a resistance $R_{11}$ (equal to the combined effective resistance of $R_3$, $R_5$, $C_3$, and $C_8$). Resistance $R_{14}$ generally represents the combined series resistance of the resistance $R_2$ (the resistance of the pixel array gate line) and a resistance $R_{12}$ (equal to the combined effective resistance of $R_4$ and $C_4$). In a balanced condition (i.e., in which $q_9$ equals zero and $V_1=V_2$):

$$q_1=C_1\times(V_d-V_1)=q_3=I_3\times T=(V_1/R_{13})\times T; \text{ and}$$

$$q_2=C_2\times(V_d-V_2)=q_4=I_4\times T=(V_2/R_{14})\times T;$$

wherein T is a time over which charge is transferred, $I_3$ is a current through $R_{13}$, and $I_4$ is a current through $R_{14}$. Further:

$$C_1/C_2=R_{14}/R_{13}, \text{ or}$$

$$C_1\times R_{13}=C_2\times R_{14}.$$

As $R_{13}=R_1+R_{11}$, and $R_{14}=R_2+R_{12}$, in the balanced condition:

$$(C_1\times R_1)+(C_1\times R_{11})=(C_2\times R_2)+(C_2\times R_{12}),$$

where the two products on the left side of the expression may be considered common time constants and the two products on the right side of the expression may be considered gate time constants. Expressed differently:

$$(C_1\times R_1)-(C_2\times R_2)=-[(C_1\times R_{11})-(C_2\times R_{12})],$$

where the two products on the left side of the expression may be considered panel time constants (and the difference of these two products may be considered the panel time constant difference) and the two products on the right side of the expression may be considered source (or driving circuitry) time constants (and the difference of these two products may be considered the source time constant difference). Consequently, by balancing the time constants (through selection of the applicable resistances and capacitances), intra-pixel crosstalk may be reduced or eliminated.

With respect to the balancing of the resistances and capacitances of the display to reduce intra-pixel crosstalk, it is noted that the ratio of $C_{dc}$ to $C_{dg}$ equals:

$$[R_2+R_4+(T/C_4)]/[R_1+(1/[(1/(R_3+(T/C_3)))+(C_8/T)+(1/R_5)])],$$

and, as previously noted:

$$\alpha=C_{dc}/C_{dg}=C_1/C_2.$$

Also:

$$\alpha=C_1/C_2=(R_2+R_{12})/(R_1+R_{11}),$$

which may instead be expressed in the form of a linear equation:

$$R_2+R_{12}=\alpha(R_1+R_{11}).$$

If $R_2$ is increased without altering any of the other parameters, then $q_9$ and $\Delta V_{12}$ will both be less than zero, $\Delta V_f$ will be greater than zero, and a pixel voltage of a previously-written pixel will increase due to intra-pixel crosstalk. Conversely, if $R_2$ is decreased without altering any of the other parameters, then $q_9$ and $\Delta V_{12}$ will both be greater than zero, $\Delta V_f$ will be less than zero, and a pixel voltage of a previously-written pixel will decrease due to intra-pixel crosstalk.

Figure 11:
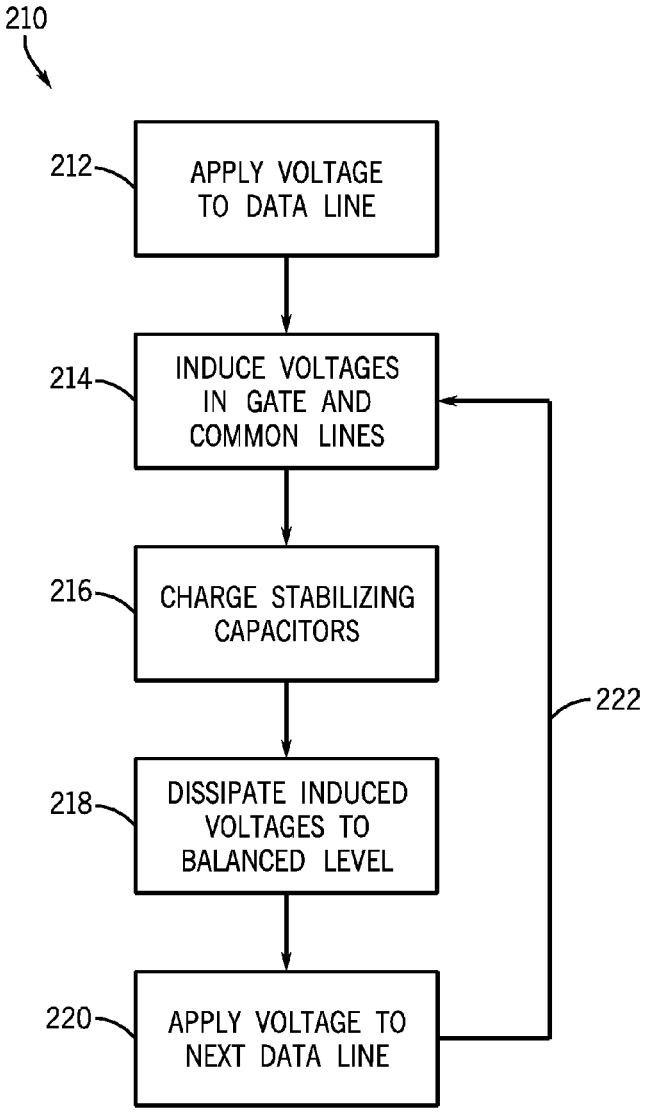
FIG. 11 is a flowchart representative of operation of an LCD panel in accordance with aspects of the present disclosure.

A flowchart 210 representative of operation of a balanced display panel is provided in FIG. 11 in accordance with one embodiment. At block 212, a data voltage may be applied to a first data line of a pixel array of a display panel. As noted above, the application of the data voltage to the first data line may induce voltages on other lines, such as a common line and a gate line of the pixel array, as generally referenced at block 214. The induced voltages on the common and gate lines may be used to charge stabilizing capacitors (e.g., $C_3$ and $C_4$ in FIG. 7), at block 216. In at least one embodiment, the charges stored by the stabilizing capacitors may be part of the charge balancing circuitry 134 (FIG. 5) and the stored charges may be recycled for driving gate and common lines to reduce power consumption of the display panel. Additionally, at block 218, the display dissipates the voltages induced on the common and gate lines in the balanced manner discussed above. The charge on these lines may be balanced before applying the next data voltage to the next data line at block 220 to reduce or eliminate intra-pixel crosstalk in the display. Particularly, the balancing of the injected charges prior to writing of the next voltage prevents the accumulation of error voltages on previously-written pixels. The application of data voltages to successive data lines, the inducing of voltages in other lines, the charging of stabilizing capacitors, and the dissipation of induced voltages to balanced levels may be repeated in an iterative fashion, as generally indicated by iterative loop 222.

Figure 12:
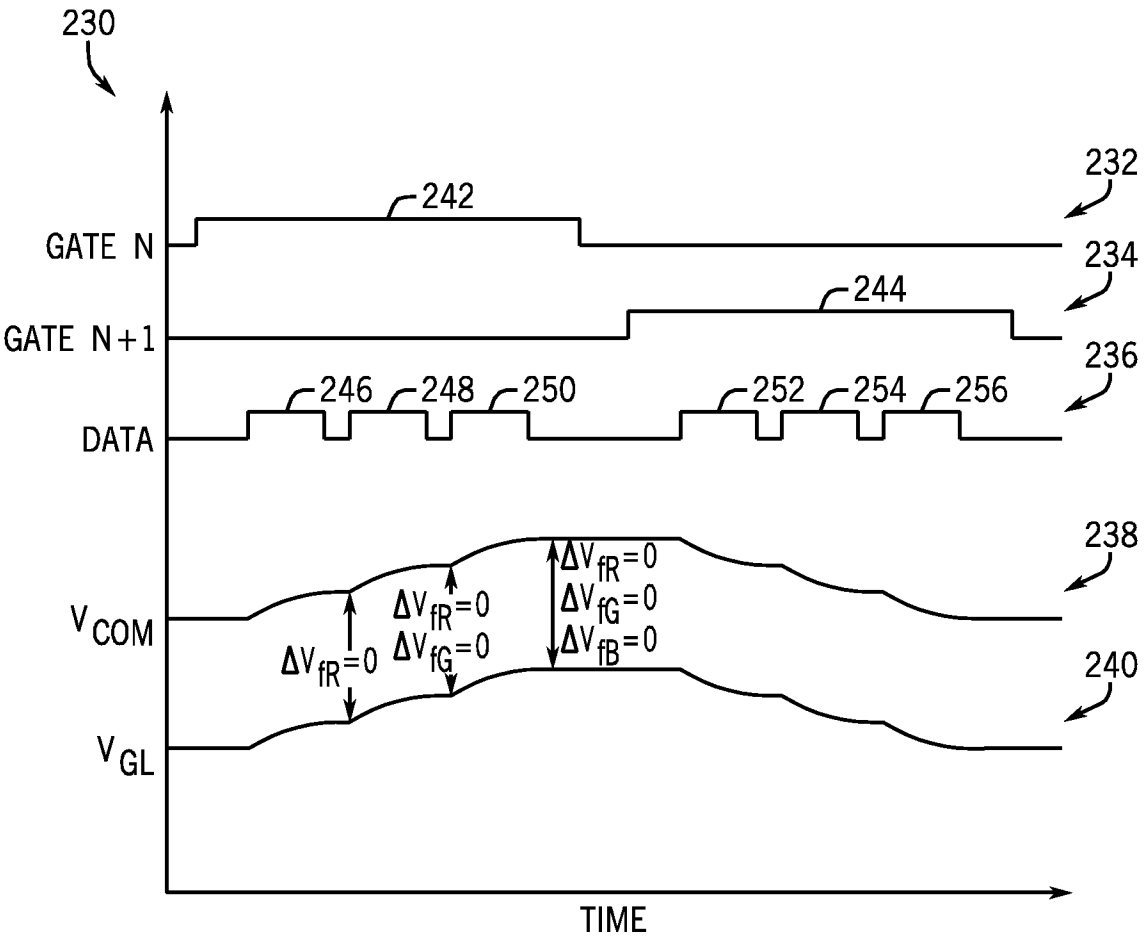
FIG. 12 generally depicts charge balancing between a gate line and a common line to reduce crosstalk between adjacent pixels in accordance with aspects of the present disclosure.

Additionally, the display panel may apply line inversion to the pixel array (i.e., alternate between the application of positive and negative voltages to rows of the array). The effect of such line inversion to the voltages on the common and gate lines is generally depicted in FIG. 12 in accordance with one embodiment, which provides various representations of display signals in a chart 230. Signals 232 and 234 represent activation signals to gates of two consecutive rows of pixels. Signal 236 represents various data values provided to data lines of the array, and signals 238 and 240 represent the change in a common voltage and a gate voltage, respectively, in response to the application of the data values to the data lines.

More particularly, gates N and N+1 may be activated at separate times as generally represented by pulses 242 and 244. When gate N is active, data values 246, 248, and 250 may be applied (via consecutive data lines) to a red pixel, a green pixel, and a blue pixel, respectively. The application of each data value 246, 248, and 250 may result in a corresponding increase in the common and gate voltages 238 and 240 due to parasitic capacitance. But in the balanced display disclosed herein, the change in the common voltage may equal (or substantially equal) the change in the gate voltage, resulting in no change (or in a small amount of change imperceptible to a user) on previously-written pixel data values. The polarity of data values 252, 254, and 256 may be reversed (in accordance with a line inversion technique) and applied to the data lines to charge pixel electrodes in the next row of pixels. These data values 252, 254, and 256 may result in a decrease in the common and gate voltages 238 and 240 due to parasitic capacitance, but the impact on the common and gate voltages may be identical in magnitude such that the changing voltages do not impact the values stored on previously-written pixel electrodes.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic display comprising:

a thin-film transistor substrate including a pixel array, the pixel array including a plurality of source lines to apply data voltages to pixel electrodes of pixels of the pixel array, a plurality of gate lines to apply gate voltages to transistors to activate the transistors and enable application of the data voltages from the plurality of source lines to the pixel electrodes, and a plurality of common lines to apply common voltages to common electrodes of the pixel array; and driving circuitry configured to apply analog signals to the pixel array, the driving circuitry including source driving circuitry to apply the data voltages to the pixel electrodes via the plurality of source lines, gate driving circuitry to apply the gate voltages to the transistors via the gate lines, and common driving circuitry to apply the common voltages to the common electrodes via the common lines;

wherein the electronic display is configured such that during operation a first capacitance is created between a source line of the plurality of source lines and a gate line of the plurality of gate lines, and a second capacitance is created between the source line and a common line of the plurality of common lines, and wherein the product of the first capacitance and the sum of a resistance of the gate line and a resistance of the gate driving circuitry coupled to the gate line is configured to be substantially equal to the product of the second capacitance and the sum of a resistance of the common line and a resistance of the common driving circuitry coupled to the common line to reduce intra-pixel crosstalk.

2. The electronic display of claim 1, wherein the driving circuitry includes a gate line stabilizing capacitor coupled between the gate line and ground, wherein the resistance of the gate driving circuitry is the effective resistance of the current carrying path including the gate line stabilizing capacitor from the gate line to ground.

3. The electronic display of claim 2, wherein the driving circuitry includes a common line stabilizing capacitor coupled between the common line and ground, wherein the resistance of the common driving circuitry is the effective resistance of the current carrying path including the common line stabilizing capacitor from the common line to ground.

4. The electronic display of claim 1, wherein the gate driving circuitry includes charge recycling circuitry to recycle charge induced on the gate line by at least one data voltage on the source line to reduce power consumption of the electronic display.

5. The electronic display of claim 1, wherein the electronic display includes a liquid crystal display.

6. The electronic display of claim 5, wherein the liquid crystal display includes a low-temperature polycrystalline silicon liquid crystal display.

7. A liquid crystal display panel comprising:

a plurality of pixels, each pixel comprising:

a common electrode;

a pixel electrode;

a liquid crystal layer responsive to electric fields generated by the common and pixel electrodes;

a data line configured to apply image signals to the plurality of pixels;

a gate line configured to apply scanning signals to the plurality of pixels; and a common line configured to apply voltage to the common electrode;

wherein the gate lines and the common lines of the respective pixels during operation are configured to reduce intra-pixel crosstalk by balancing and substantially equalizing relaxation times of the gate lines to the common lines such that a voltage induced on the gate line is substantially equal to a voltage induced on the common line of a particular pixel as a result of a voltage on the data line of the particular pixel and the voltages dissipate at substantially equal rates.

8. The liquid crystal display panel of claim 7, comprising driving circuitry formed on a substrate including the plurality of pixels.

9. The liquid crystal display panel of claim 8, wherein the driving circuitry is configured to apply voltage signals to the data lines, the gate lines, and the common lines.

10. The liquid crystal display panel of claim 8, wherein the driving circuitry is configured to recycle charge attributable to the respective voltages induced on the gate line and the common line of the particular pixel.

11. The liquid crystal display panel of claim 7, comprising at least one of a fringe-field switching liquid crystal display panel or an in-plane switching liquid crystal display panel.

12. A method comprising:

applying a first voltage to a data line of a pixel array such that a second voltage is induced in a gate line of the pixel array having a gate line resistance and a gate line capacitance and a third voltage is induced in a common line of the pixel array having a common line resistance and a common line capacitance;

applying a fourth voltage to an additional data line adjacent to the data line to which the first voltage was applied, wherein the applying of the fourth voltage to the additional data line induces a fifth voltage in the gate line and induces a sixth voltage in the common line; and partially dissipating the second voltage in the gate line and the third voltage in the common line before the applying of the fourth voltage such that the portion of the second voltage remaining in the gate line becomes substantially equal and balanced to the portion of the third voltage remaining in the common line upon the application of the fourth voltage to the additional data line, wherein the balancing is accomplished due to selection of the gate line resistance, gate line capacitance, common line resistance, common line capacitance, or any combination thereof.

13. The method of claim 12, comprising applying the second voltage to a first stabilization capacitor in series with the gate line to charge the first stabilization capacitor.

14. The method of claim 13, comprising applying the third voltage to a second stabilization capacitor in series with the common line to charge the second stabilization capacitor.

15. The method of claim 12, comprising:

applying a seventh voltage to a second additional data line adjacent to the additional data line to which the fourth voltage was applied, wherein the applying of the seventh voltage to the second additional data line induces an eighth voltage in the gate line and induces a ninth voltage in the common line; and partially dissipating the fifth voltage in the gate line and the sixth voltage in the common line before the applying of the seventh voltage such that the portion of the second and fifth voltages remaining in the gate line is substantially equal to the portion of the third and sixth voltages remaining in the common line upon the application of the seventh voltage to the second additional data line.

16. The method of claim 15, comprising partially dissipating the eighth voltage in the gate line and the ninth voltage in the common line before the applying of an additional voltage to the data line such that the portion of the second, fifth, and eighth voltages remaining in the gate line is substantially equal to the portion of the third, sixth, and ninth voltages remaining in the common line upon the application of the additional voltage to the data line.

17. A system comprising:

a processor;

a memory; and a display including a pixel array and driving circuitry configured to apply analog signals to the pixel array, wherein the display is configured to employ one or more resistors, one or more capacitors, or combination thereof on any one of a gate line, an adjacent common line, or both to reduce intra-pixel crosstalk by balancing by balancing charges induced on the gate line and on the common line of the pixel array in response to application of a first data voltage on a first data line such that the charge on the gate line is substantially equal to the charge on the adjacent common line, and wherein the display is configured to balance the charges induced on the gate line and on the adjacent common line of the pixel array before applying a second data voltage to a second data line adjacent the first data line.

18. The system of claim 17, wherein the pixel array and the driving circuitry are formed on the same substrate.

19. The system of claim 17, wherein the pixel array includes a plurality of pixels of different colors.

20. The system of claim 17, wherein the plurality of pixels of different colors includes red pixels, green pixels, and blue pixels.

21. The system of claim 17, wherein the balancing of the charges induced on the gate line and on the adjacent common line reduces intra-pixel crosstalk between unit pixels of different colors.

22. The system of claim 17, wherein the system includes a handheld portable telephone or a laptop computer.

23. The system of claim 1, wherein the first capacitance that is created between the source line and the gate line is not substantially equal to the second capacitance that is created between the source line and the common line.

* * * * *